US006246844B1

(12) United States Patent
Shiba

(10) Patent No.: US 6,246,844 B1
(45) Date of Patent: Jun. 12, 2001

(54) DENSITY CONTROL APPARATUS IN IMAGE FORMATION APPARATUS

(75) Inventor: Hiroshi Shiba, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/357,978

(22) Filed: Jul. 21, 1999

(30) Foreign Application Priority Data

Jul. 23, 1998 (JP) ..... 10-208330
Oct. 28, 1998 (JP) ..... 10-307082

(51) Int. Cl.[7] ..... G03G 15/00; G03G 15/08
(52) U.S. Cl. ..... 399/49; 358/504; 399/72
(58) Field of Search ..... 399/49, 72, 15, 399/60, 46; 358/504, 406, 296

(56) References Cited

U.S. PATENT DOCUMENTS 5,678,132 10/1997 Shiba et al. ..... 399/59
5,722,007 * 2/1998 Ogata et al. ..... 399/49
5,809,365 * 9/1998 Yoshizawa ..... 399/49 X

FOREIGN PATENT DOCUMENTS 1-197777 * 8/1989 (JP) .
2-080920 * 3/1990 (JP) .
2-139580 * 5/1990 (JP) .

* cited by examiner

*Primary Examiner*—Sophia S. Chen
(74) *Attorney, Agent, or Firm*—Fitzpatrick, Cella, Harper & Scinto

(57) ABSTRACT

In a density control apparatus capable of coping with a change in light sensitivity, an image formation device forms a toner image on a photosensitive body on the basis of an image signal, a sensor measures density of the toner image formed on the photosensitive body, a correction device causes the sensor to measure density of a portion where the toner image is not formed on the photosensitive body and corrects sensitivity of the sensor on the basis of the measured result, a setting device sets a level shifting quantity of an output signal from the sensor after the sensitivity of the sensor is corrected by the correction device, and a determination device causes to form plural images of different densities and determines an image formation condition on the basis of the result of measuring the density of the images and the shifting quantity set by the setting device.

19 Claims, 17 Drawing Sheets

DENSITY CONTROL APPARATUS IN IMAGE FORMATION APPARATUS

BACKGROUND OF THE INVENTION

1. Field of the Invention

The present invention relates to the control of image density in an image formation apparatus.

2. Related Background Art

As a conventional example, the structure of a multi-color image formation apparatus as well as its operation will be described with reference to FIG. 1.

In FIG. 1, latent images formed every each of colors on an image support body (photosensitive drum) 100 by an optical unit 101 are developed and visualized using each of color toners of Y (yellow), M (magenta), C (cyan) and K (black) respectively supplied from color developing units of Dy, Dm, Dc and Dk. Then the developed and visualized images are plural times transferred on an external surface of a transfer belt 102 so as to form a multi-color image. In this condition, the toner is transferred to a surface of the transfer belt 102 by applying high voltage on the transfer belt 102. Then a recording sheet (paper) 105 fed from a sheet feed unit 103 or a sheet feed toner 104 is conveyed through a sheet conveying path and the multi-color image is re-transferred from the transfer belt 102.

Thereafter, the recording sheet 105 is conveyed by a conveying roller 106 and is fixed by a fixing unit 107 to be discharged to a discharge tray 108 or a discharge unit 109. The each of color developing units, which has a rotation spindle at its both edges, capable of being rotated around the spindle is held in a developing mechanical unit 110 and is rotated to be selected. Numeral 111 denotes a cleaning unit for cleaning the toner on the transfer belt 102. Numeral 112 denotes a discharged toner collection unit for collecting discharged toners from the image support body 100. Numeral 113 denotes a density sensor for measuring density of a toner image formed on the photosensitive body 100.

In the above-described structure, as shown in FIG. 2, a beam is radiated from a light emitting element 1 structured within the density sensor 113, which is disposed in the vertical direction to a surface of the image support body 100, to a toner image 20 (called as patch hereinafter) formed on the image support body 100. Then a reflected light is detected by a light reception element 2 to realize such a structure as stabilizing image density by correcting a difference between the detected result and a predetermined detection level as a change quantity corresponding to a developing bias.

An example of the content concerning a density control will be described. The density control can be categorized into a developing bias control for obtaining a developing bias value treated as a maximum value of toner density and a halftone density control for controlling halftone density by varying image data upon fixing the developing bias value defined by the developing bias control. Hereinafter, the developing bias control will be described.

FIG. 3 is a block diagram of the structure concerning the developing bias control. In FIG. 3, numeral 3 denotes an A/D converter which converts an analog detection signal transferred from the density sensor (light reception element) 113 into a digital signal. Numeral 4 denotes a data comparison means which judges whether or not an output value of the density sensor for a surface ground of the image support body reaches a predetermined value. Numeral 5 denotes an LED light quantity setting unit which varies light quantity so as to secure an output range in case of measuring several kinds of patches.

Numeral 6 denotes a data storage means which interpolates detected data. Numeral 7 denotes a density calculation unit which changes a sensor output value of the measured patch in terms of a density value. Numeral 8 denotes a density/developing bias comparison unit which determines the density value changed by the density calculation unit 7 and the developing bias value corresponding to the density value.

Numeral 9 denotes a developing bias control unit which gives a command to a high-voltage output unit 10 so as to output the determined developing bias value. The high-voltage output unit 10 applies an output designated from the developing bias control unit 9 to the developing unit. Numeral 50 denotes a CPU within a DC controller (not shown) provided in an image formation apparatus main body. Depending on the structure, each of the blocks 3, 4, 5, 6, 7, 8 and 9 provided in the CPU 50 may be provided in the DC controller (not shown) or the density sensor 113.

FIG. 4 is an operational flow chart of the developing bias control. In FIG. 4, the ground of the image support body surface is measured in a step S101. A flow advances to a step S102, where if a read value of the ground of the image support body surface is lower than a predetermined density value, the flow advances to a step S104. If the read value of the ground of the image support body surface is higher than the predetermined density value because of dirt or an inferior change in time of the density sensor 113, a density sensor output is corrected in a step S103.

The density sensor output is corrected by each block of the A/D converter 3, data comparison means 4, the LED light quantity setting unit 5 and the data storage means 6 shown in FIG. 3. In the step S104, density of the ground surface on a position, where the patch on the image support body is to be printed, is measured. Then density of the patch is measured in a step S105. In this case, the density of the patch for the ground can be measured as contrast by measuring the density of the ground in the step S104. The flow advances to a step S107 after converting the read value of the density sensor 113 into the density value in a step S106. A method for determining an optimum developing bias value performed in the step S107 will be described hereinafter.

FIG. 5 shows examples of measured patches. A patch 20-*a* is in the lowest density and a patch 20-*e* is in the highest density. The density is schematically expressed by hatching lines. The number of patches is not limited to these examples but may be varied depending on a diameter of the image support body or time spend in controlling the density. FIG. 6 shows the relationship between the density value being the measured result of patches 20-*a*, 20-*b*, 20-*c* and 20-*d* shown in FIG. 5 by the density sensor 113 and the developing bias value when the patches are formed.

In FIG. 6, in a case where a target density value want to be obtained among the measured density of five patches exits on somewhere between two points, the optimum developing bias value for the target density can be obtained by performing a linear interpolation for the two points.

FIG. 7 indicates a case that all patches which are measured can not reach the target density. In this case, the linear interpolation is performed for the two patches of which density is closer to the target density so as to estimate the optimum developing bias value for the target density.

FIG. 8 indicates a case that all patches which are measured can not reach the target density and the density value reaches peak between the patches 20-*b* and 20-*d*. In this case, the developing bias value of the patch of which density is closest to the target density (patch reaches a peak of the density) is treated as the optimum developing bias value.

The halftone density control is performed after determining the optimum developing bias indicating a maximum density by the developing bias control. Also, in case of the halftone density control, a plurality of patches are printed on the image support body to measure the patches density by the density sensor 113 similar to the case of the developing bias control. The relationship between image data of the halftone density control patch and the density value is shown in FIG. 9. On an image data/density characteristic curve shown in FIG. 9, since a raise of the density is remarkable in the vicinity of center position of the image data, a halftone correction curve is obtained by calculation so as to perform such a process as correcting the characteristic curve in linear as shown in FIG. 10. Consequently, reproductive precision of halftone density, which is largely changed in color reproductivity of an image, can be improved.

However, conventionally, in measuring of the patch density when toner image density is controlled, there occurs such an inconvenient situation as an output voltage when a beam is radiated to the image support body (assumed as reference voltage V0) becomes more sensitive for the light due to a material characteristic of the image support body of which surface is scraped off because of a long period use of a color image formation apparatus. Also, there occurs such an inconvenient situation as resulted in deteriorating light sensitivity because of dirt of the density sensor due to dirt of toners in the image formation apparatus.

SUMMARY OF THE INVENTION

An object of the present invention is to provide a density control apparatus and method thereof for eliminating the above-described drawback.

Another object of the present invention is to provide the density control apparatus and method thereof for enabling to cope with a change in light sensitivity.

Still another object of the present invention is to provide the density control apparatus and method thereof for controlling density adapting to an inferior change in time of an apparatus by correcting a measured value of the density and light quantity when a patch is measured.

Still another object of the present invention is to provide the density control apparatus and method thereof for precisely controlling the density by effectively using a dynamic range of an A/D converter.

Other objects of the present invention will become apparent from the following description based on the attached drawings and the appended claims.

DETAILED DESCRIPTION OF PREFERRED EMBODIMENTS

Hereinafter, the preferred embodiments of the present invention will be described in detail with reference to the attached drawings.

First Embodiment

Figure 1:
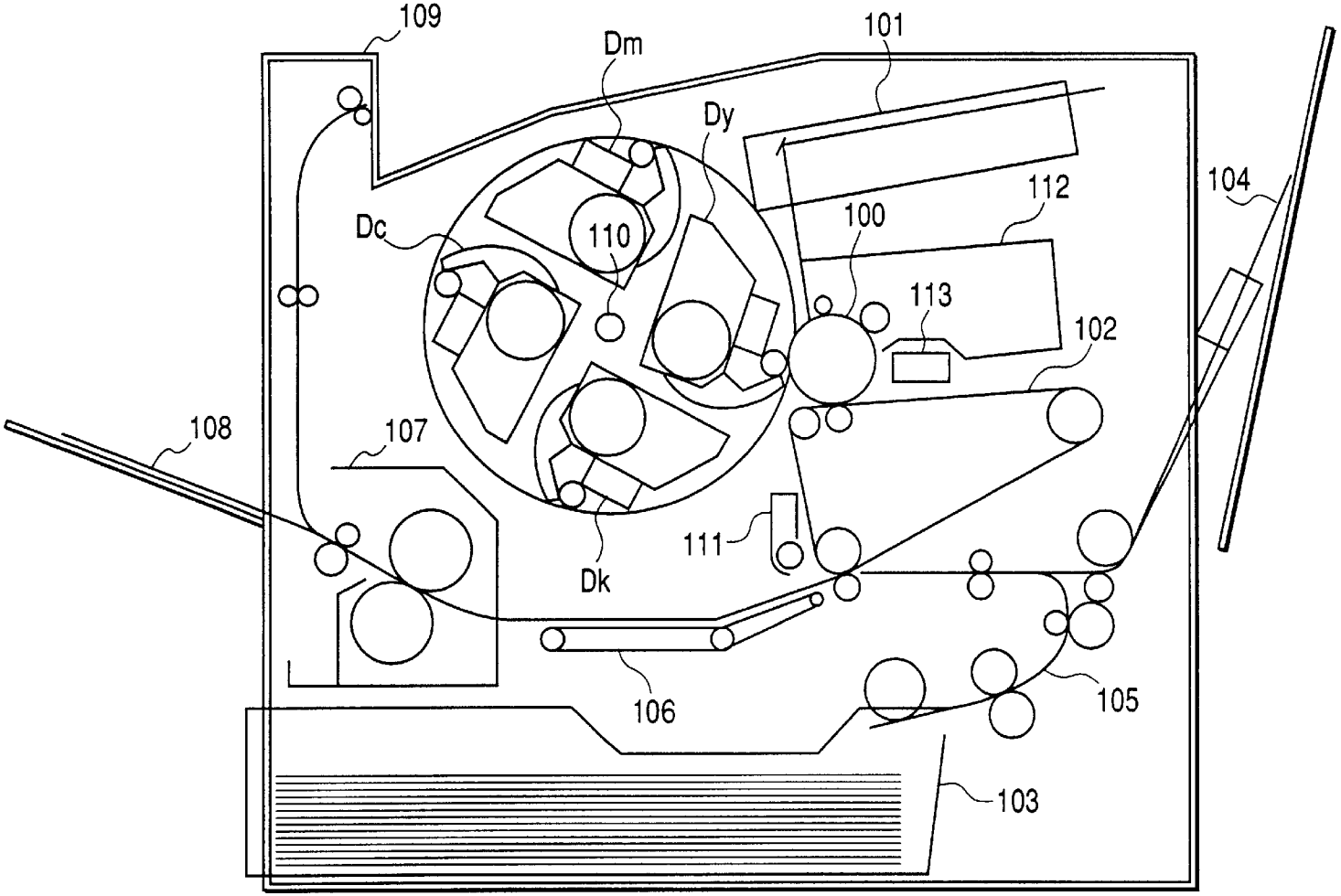
FIG. 1 is a cross-sectional view of an image formation apparatus.
Figure 2:
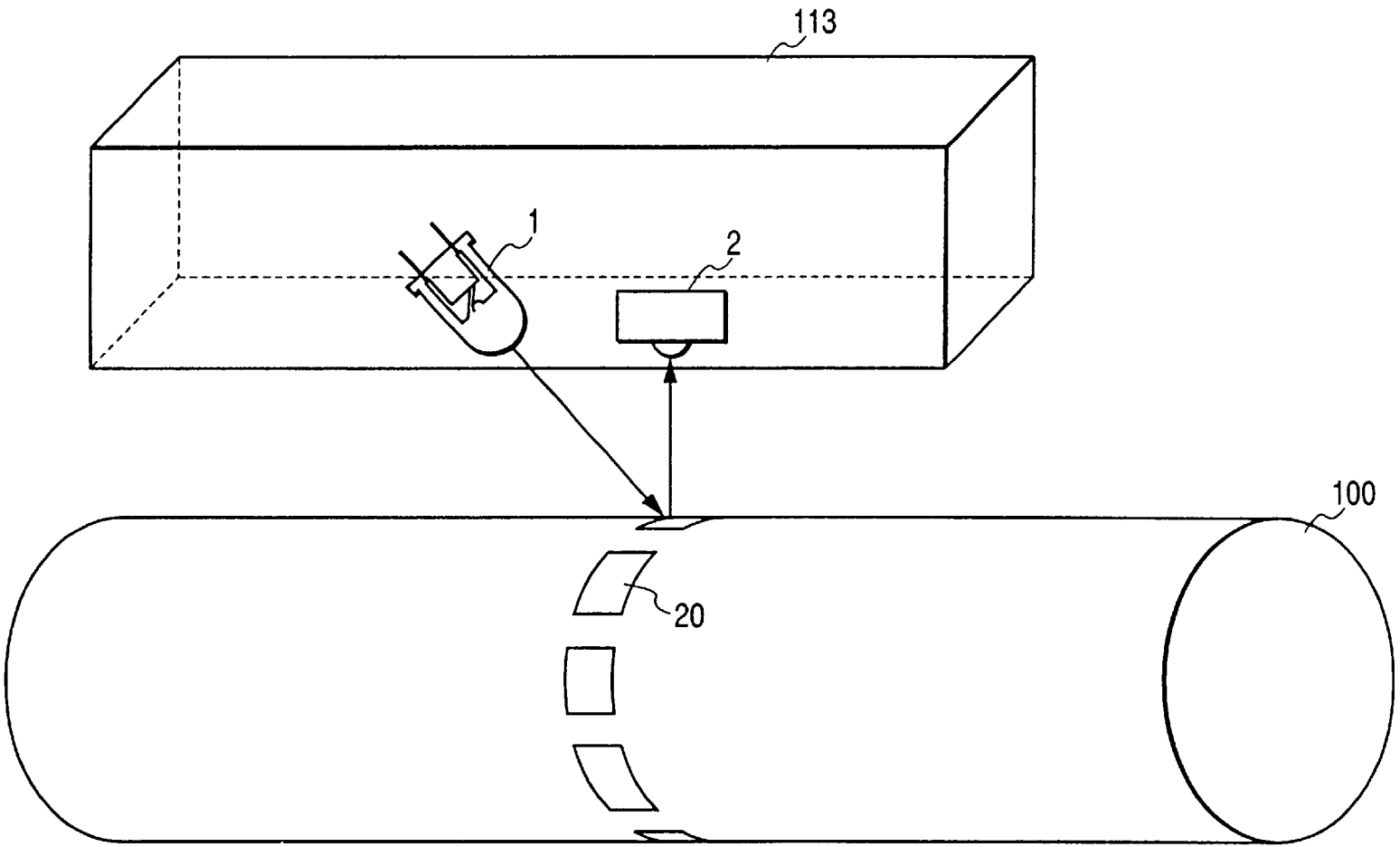
FIG. 2 PRIOR ART
FIG. 2 is a structural view showing a conventional toner patch measurement.
Figure 3:
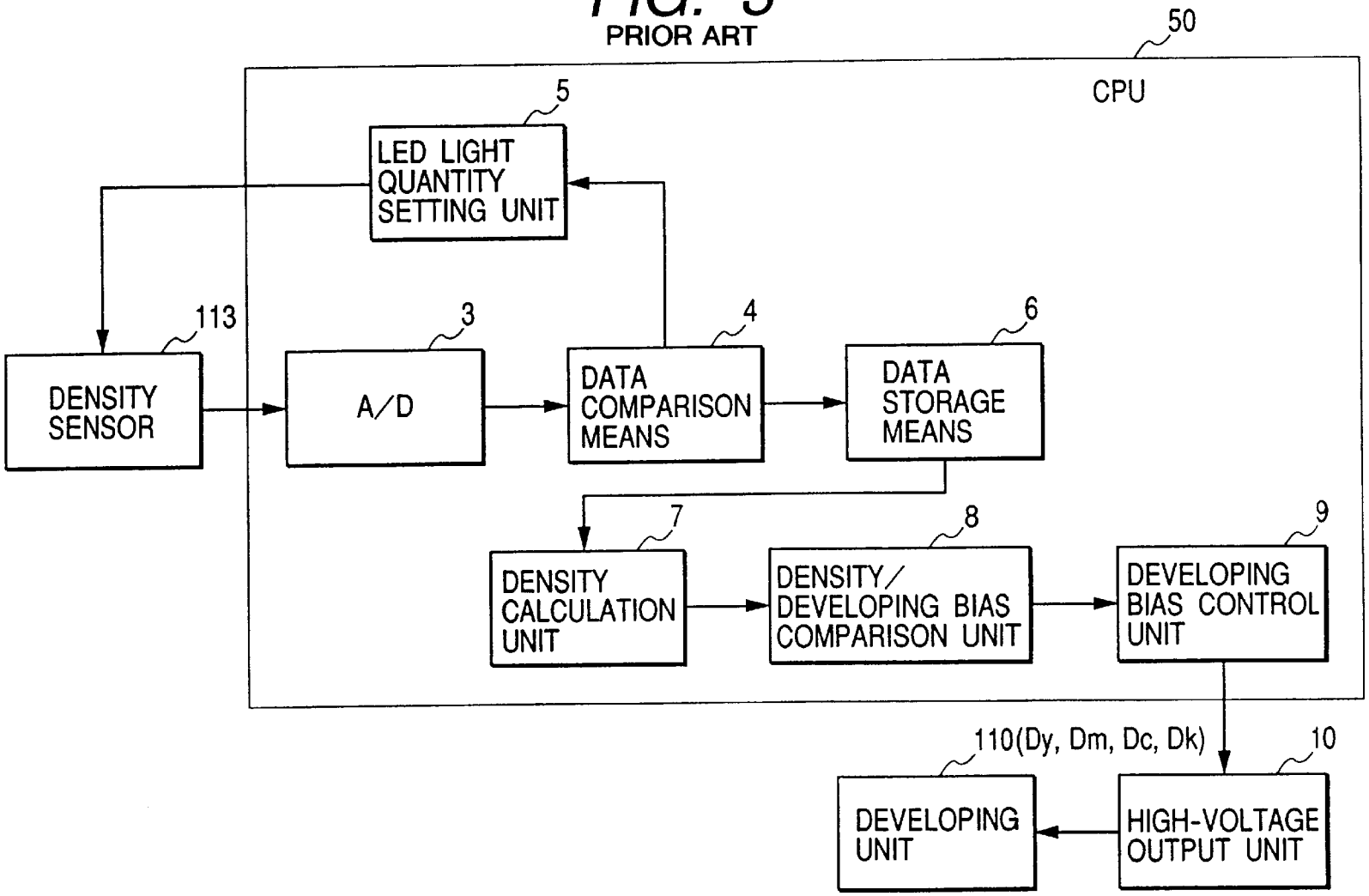
FIG. 3 PRIOR ART
FIG. 3 is a block diagram for explaining a conventional developing bias control.
Figure 4:
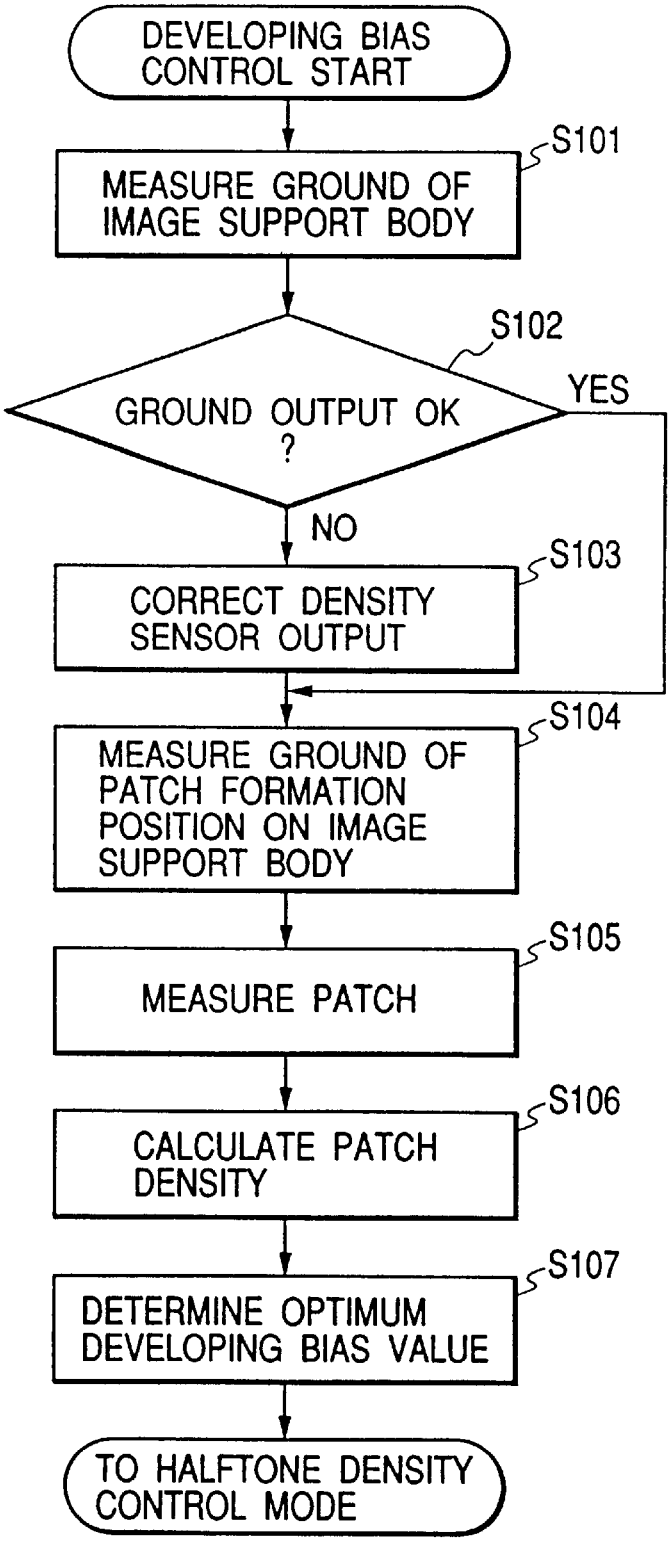
FIG. 4 PRIOR ART
FIG. 4 is a flow chart showing contents of the conventional developing bias control.
Figure 5:
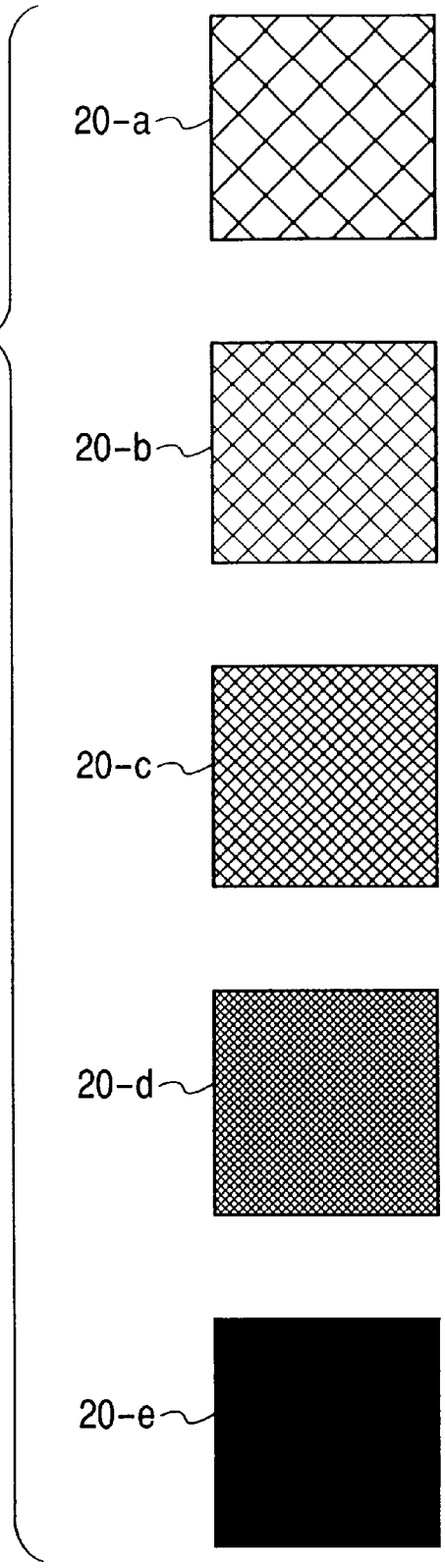
FIG. 5 is an explanation view showing examples of patches measured by a developing bias control.
Figure 6:
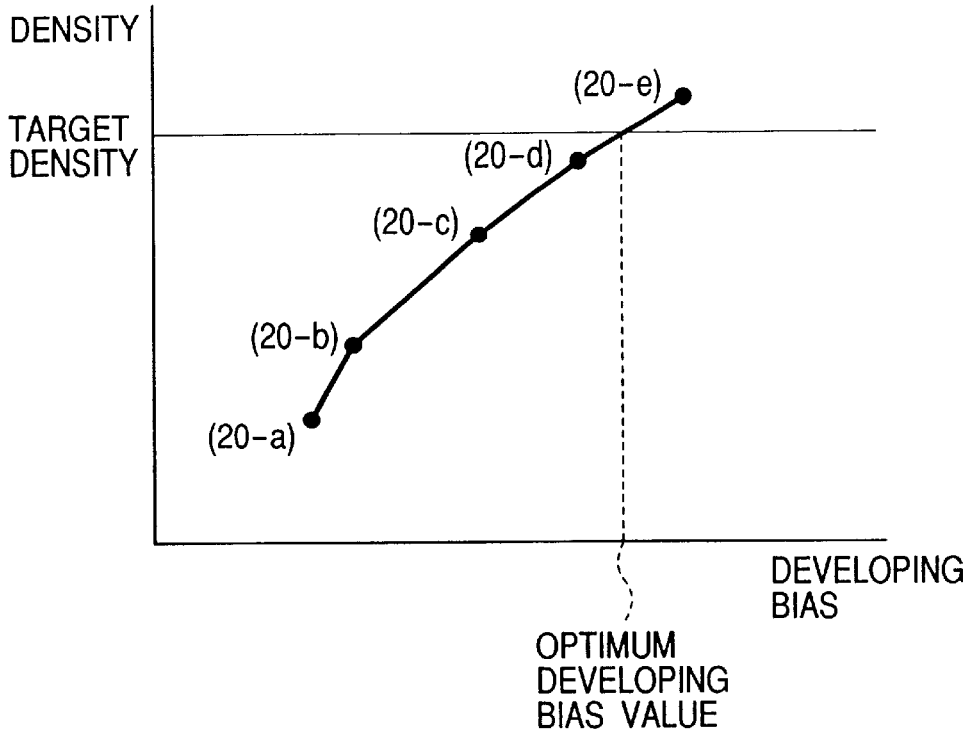
FIG. 6 is an explanation view for explaining a process to obtain an optimum developing bias value.
Figure 7:
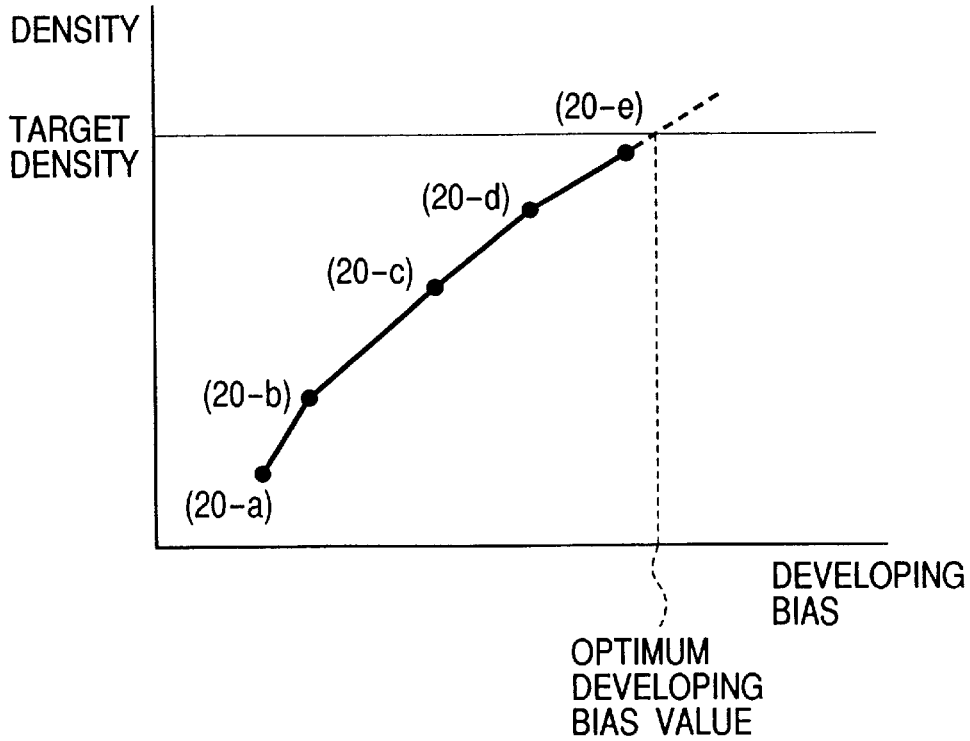
FIG. 7 is an explanation view for explaining the process to obtain the optimum developing bias value.
Figure 8:
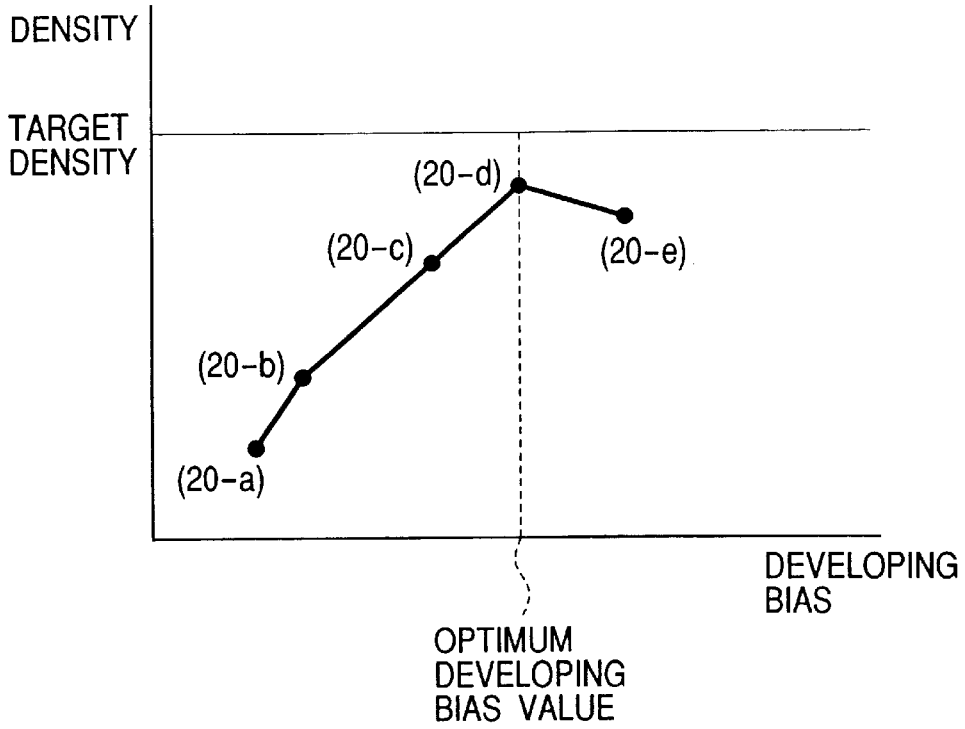
FIG. 8 is an explanation view for explaining the process to obtain the optimum developing bias value.
Figure 9:
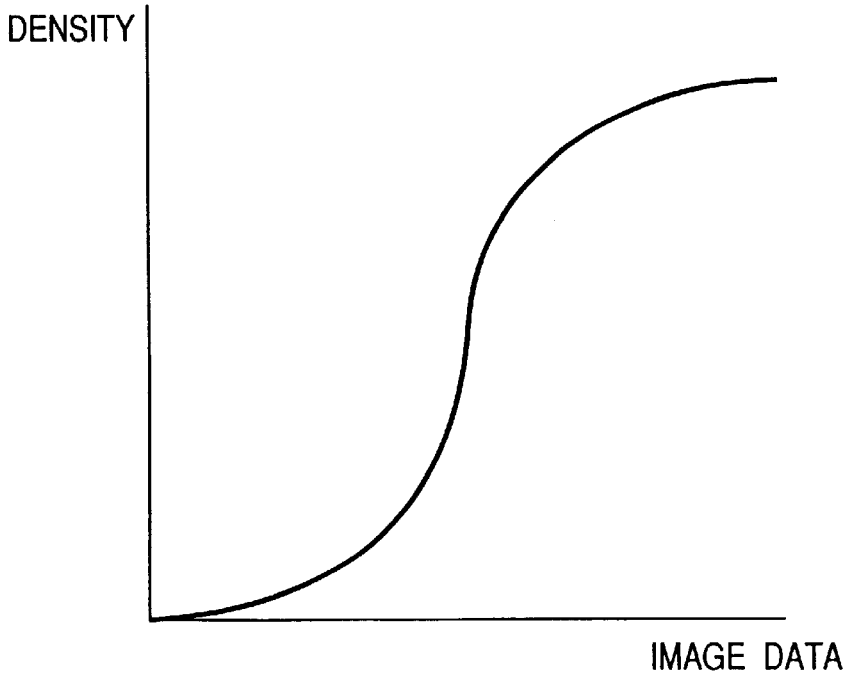
FIG. 9 is an explanation view showing an image data/density characteristic curve in a halftone density control.
Figure 10:
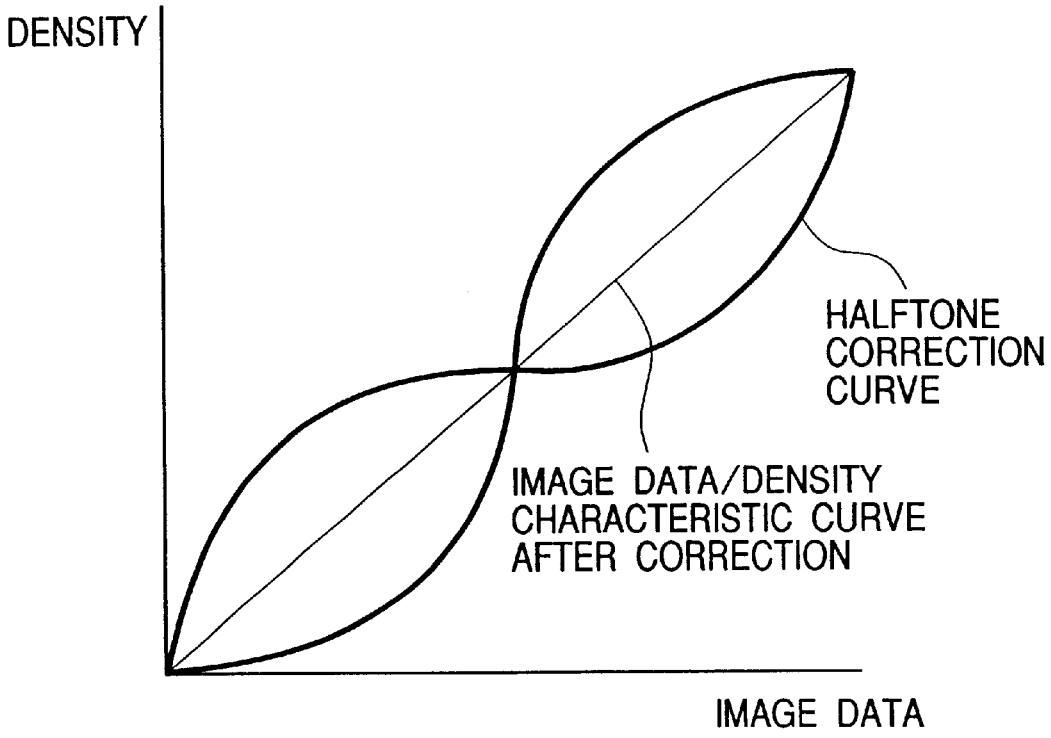
FIG. 10 is an explanation view for explaining a process to obtain a halftone correction curve.
Figure 11:
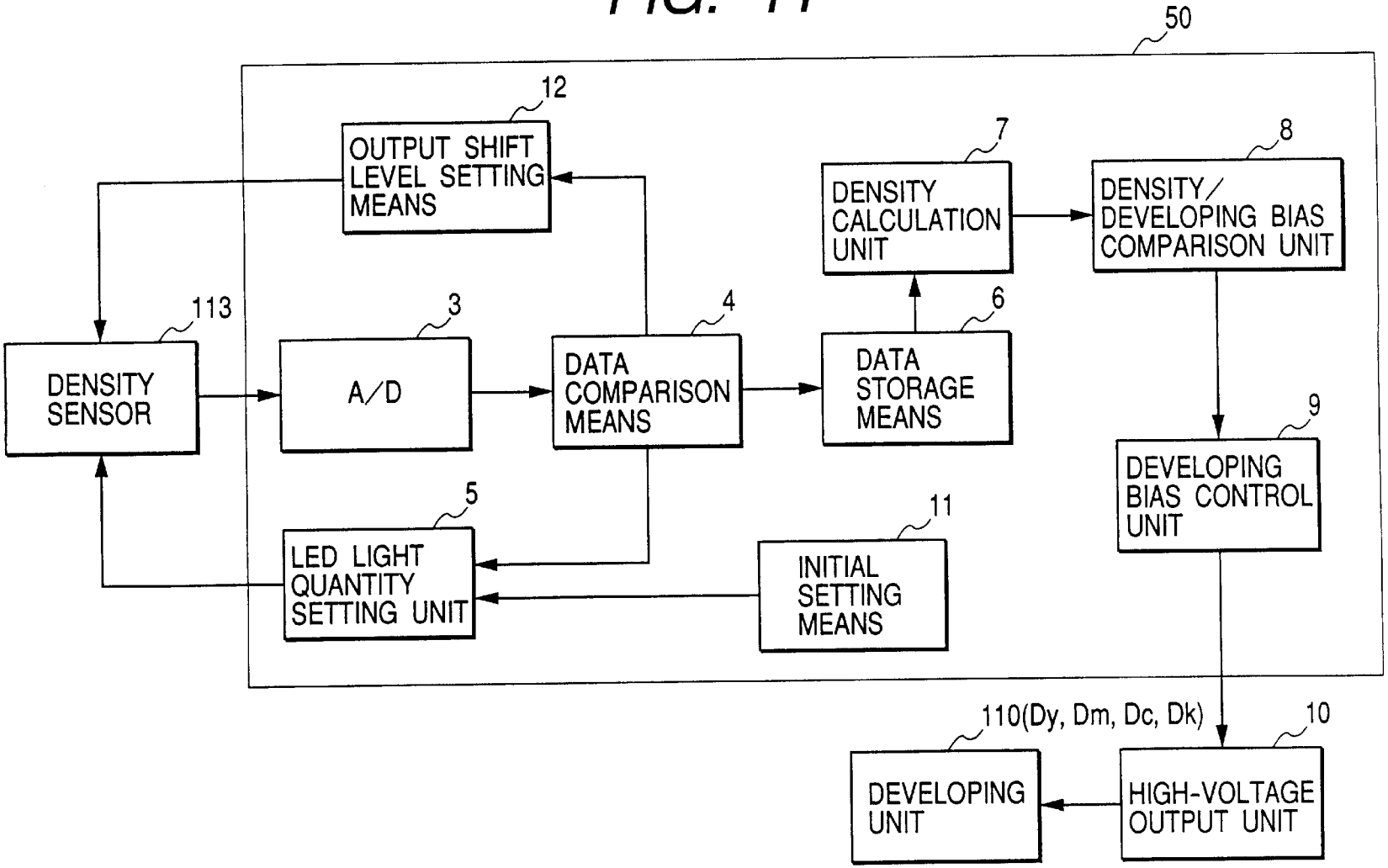
FIG. 11 is a block diagram showing circuit structure in a first embodiment of the present invention.

FIG. 11 shows a structure of a circuit in the first embodiment of the present invention. In FIG. 11, the same numerals are given to the same portions as those shown in FIG. 3 of a conventional example and a detailed description will be omitted. In FIG. 11, numeral 11 denotes an initial setting means, which transmits a command of an initial light quantity setting value to an LED light quantity setting unit 5. Numeral 12 denotes an output shift level setting means, which shifts voltage for an output voltage from a density sensor (light reception element) 113 depending on a obtained result in a data comparison means 4. Numeral 50 denotes a CPU within a DC controller (not shown) provided in a color image formation apparatus main body. Depending on the structure, each of blocks 3, 4, 5, 6, 7, 8, 9, 10 and 11 provided in the CPU 50 may be provided in the DC controller or the density sensor 113.

Figure 12:
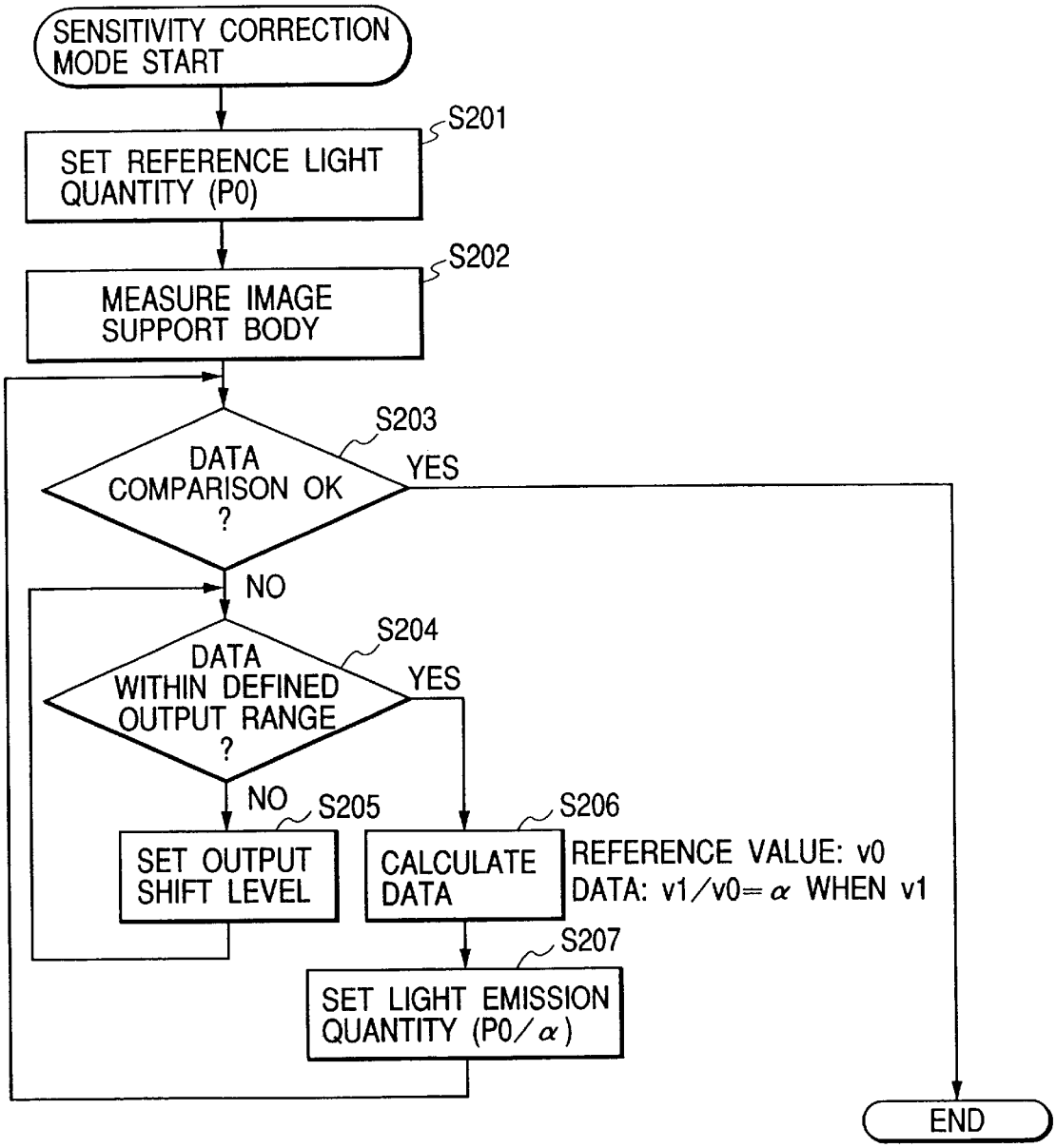
FIG. 12 is a flow chart showing process contents in the first embodiment of the present invention.

FIG. 12 is a flow chart for explaining an operation in the first embodiment of the present invention. In FIG. 12, when a sensitivity correction mode is started, at first, a reference light quantity P0 used in measuring surface ground density of an image support body is set from the LED light quantity setting unit 5 by the command from the initial setting means 11 in a step S201. In a step S202, the ground density of the image support body is measured using the reference light quantity P0. A flow advances to a step S203, where the output voltage of the density sensor 113 being the measured result is transmitted to the CPU 50 in the step S202 to be compared whether or not the output voltage is within an acceptable error range for a reference voltage value by the data comparison means 4 after passing through an A/D converter 3.

In a case where the compared result is in N.G. state, the flow advances to a step S204. In the step S204, it is judged whether or not data transmitted from the density sensor 113 is within a defined output voltage range. Herein, the defined output voltage range indicates the output voltage range of the density sensor 113 and an input voltage range of the CPU 50. In a case where the data is not within the defined output voltage range, the flow advances to a step S205, where the output voltage is shifted by the output shift level setting means 12. This process is repeated until the data is included within the defined output voltage range. When the data is included within the defined output voltage range, the flow advances to a step S206.

In the step S206, v1/v0 (=α) is calculated as a correction value using a predetermined reference voltage (V0) of the image support body and an actually measured output voltage data (V1). The flow advances to a step S207, where the LED light quantity setting unit is set to correct a light emission quantity to (P0/α) by introducing the correction value obtained in the step S206. The flow returns to the step S203, where the sensitivity correction mode is terminated if the data is within the acceptable error range for the reference value, as a result of comparing the data.

Figure 13:
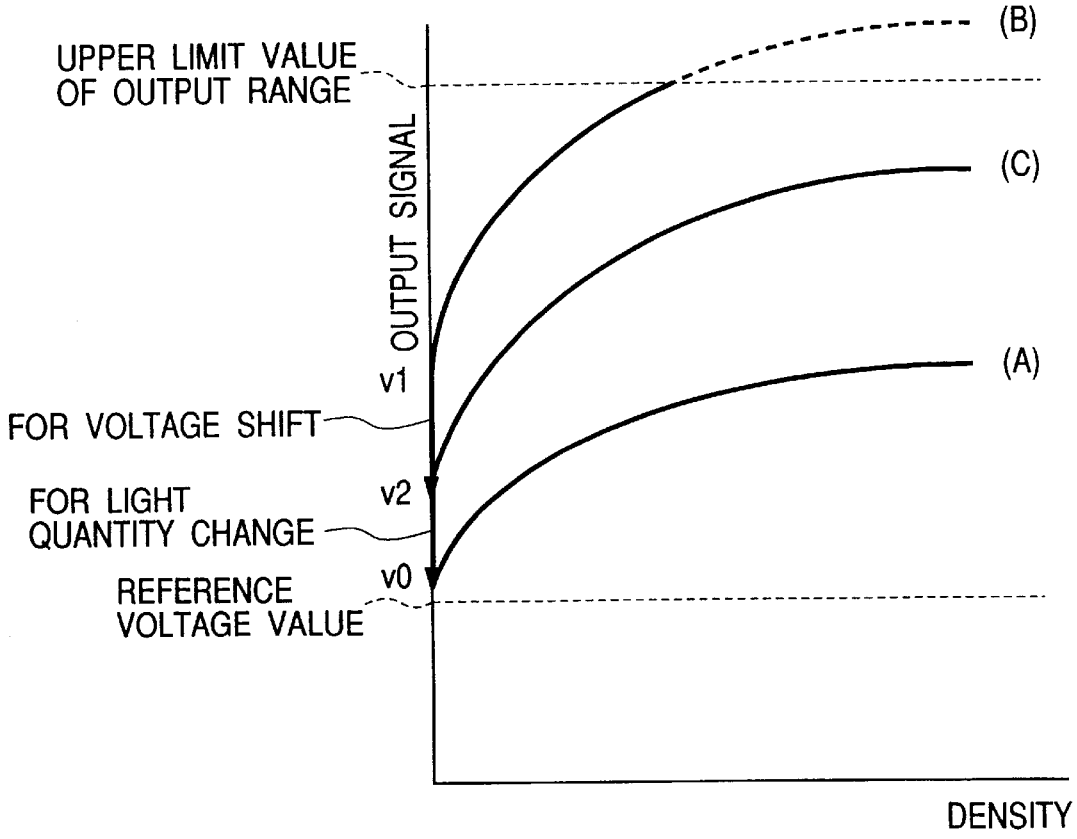
FIG. 13 is an explanation view for explaining an operation in the first embodiment of the present invention.

The above-described process is described with reference to a graphic chart shown in FIG. 13. In FIG. 13, a previously estimated voltage value as an output, when a beam is radiated on a surface of the image support body 100 by the density sensor 113 and a reflected light is measured, is defined as v0. That is, the output voltage for the ground density is defined as v0. When the v0 is assumed as a reference value, an output voltage characteristic curve estimated as the output voltage value corresponding to density of a toner image formed on the image support body is defined as (A). An output voltage value corresponding to the surface ground density of the image support body in case of changing sensitivity due to an use of the image support body is defined as v1. An output voltage characteristic curve corresponding to the density of the toner image to be formed is defined as (B).

As described in the flow chart in FIG. 12, the output voltage v1 of the surface in case of changing the sensitivity of the image support body sometimes exceeds an upper limit value of the output range. On the curve (B), in a case where the v1 exceeds the upper limit value of the output range or a voltage value of the output voltage characteristic curve is seemed to exceed the upper limit value of the output range, the output voltage is shifted below such that the characteristic curve is to be included in the output range. In this case, an output voltage corresponding to the surface ground density of the image support body is defined as v2 and an output voltage characteristic curve corresponding to the density of the toner image is defined as (C). In case of comparing the curve (A) with the curve (C), since the sensitivity characteristic of the image support body has been changed due to a long period use of the image support body, the characteristic of the curve (A) does not coincide with that of the curve (C). For this reason, the v0 and v2, which are the output voltages corresponding to the surface ground density of the image support body, are compared each other to execute a process for coinciding two points by varying light emission quantity of an LED 1. Therefore, a change in the sensitivity of the image support body can be corrected.

In the above-described embodiment, a case of changing the sensitivity of the image support body is described. However, also in case of decreasing the light emission quantity because of dirt of the density sensor due to dust such as toners, a correction can be similarly performed by shifting the output voltage and varying the light emission quantity.

Second Embodiment

Figure 14:
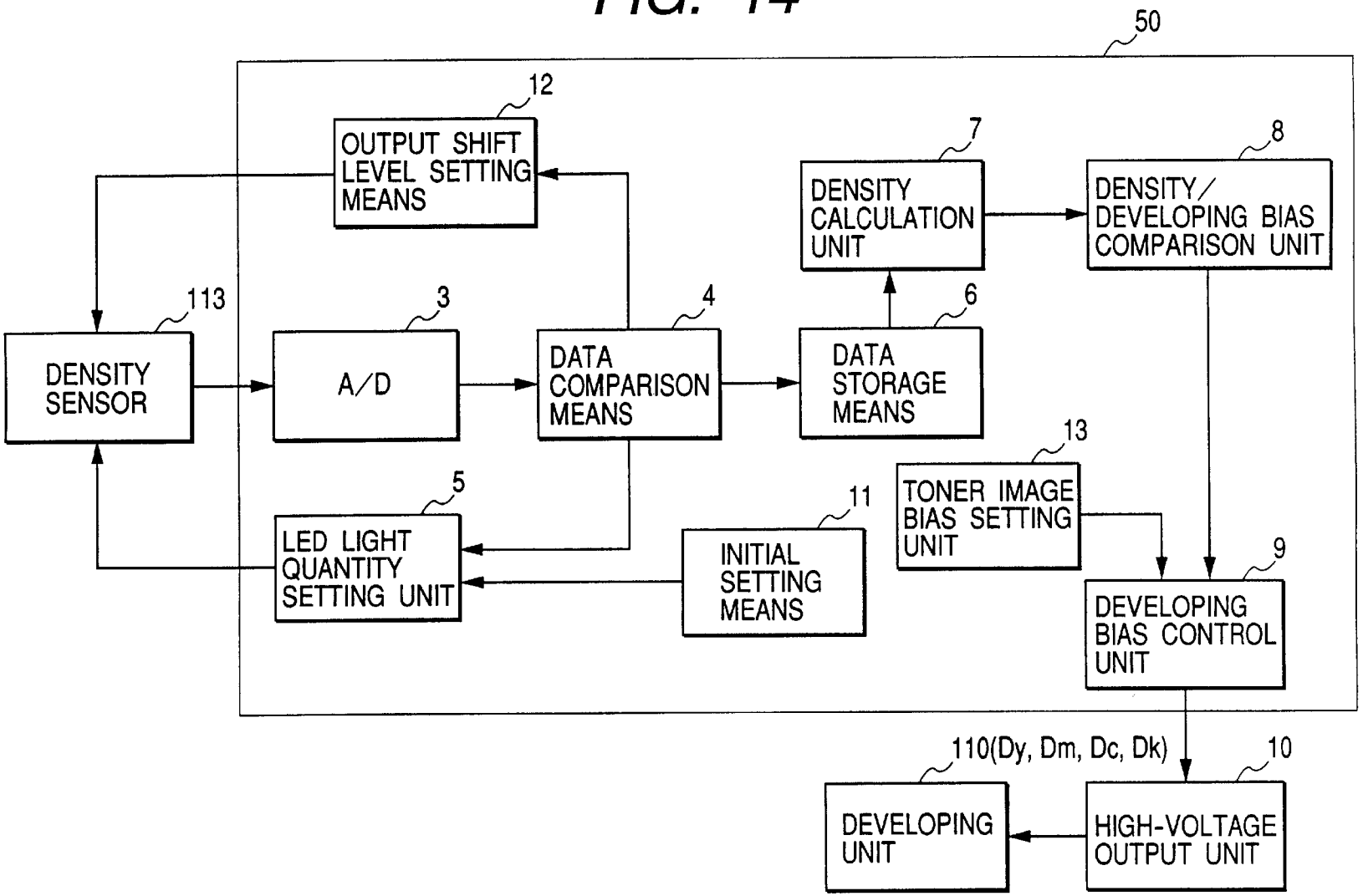
FIG. 14 is a block diagram showing a circuit structure in a second embodiment of the present invention.

FIG. 14 shows a circuit structure in the second embodiment of the present invention. The same numerals are given to the same portions as those shown in FIG. 3 of a conventional example and FIG. 11 of the first embodiment and a detailed description will be omitted. In FIG. 14, numeral 13 denotes a toner image bias setting unit for developing a latent image formed on an image support body.

Figure 15:
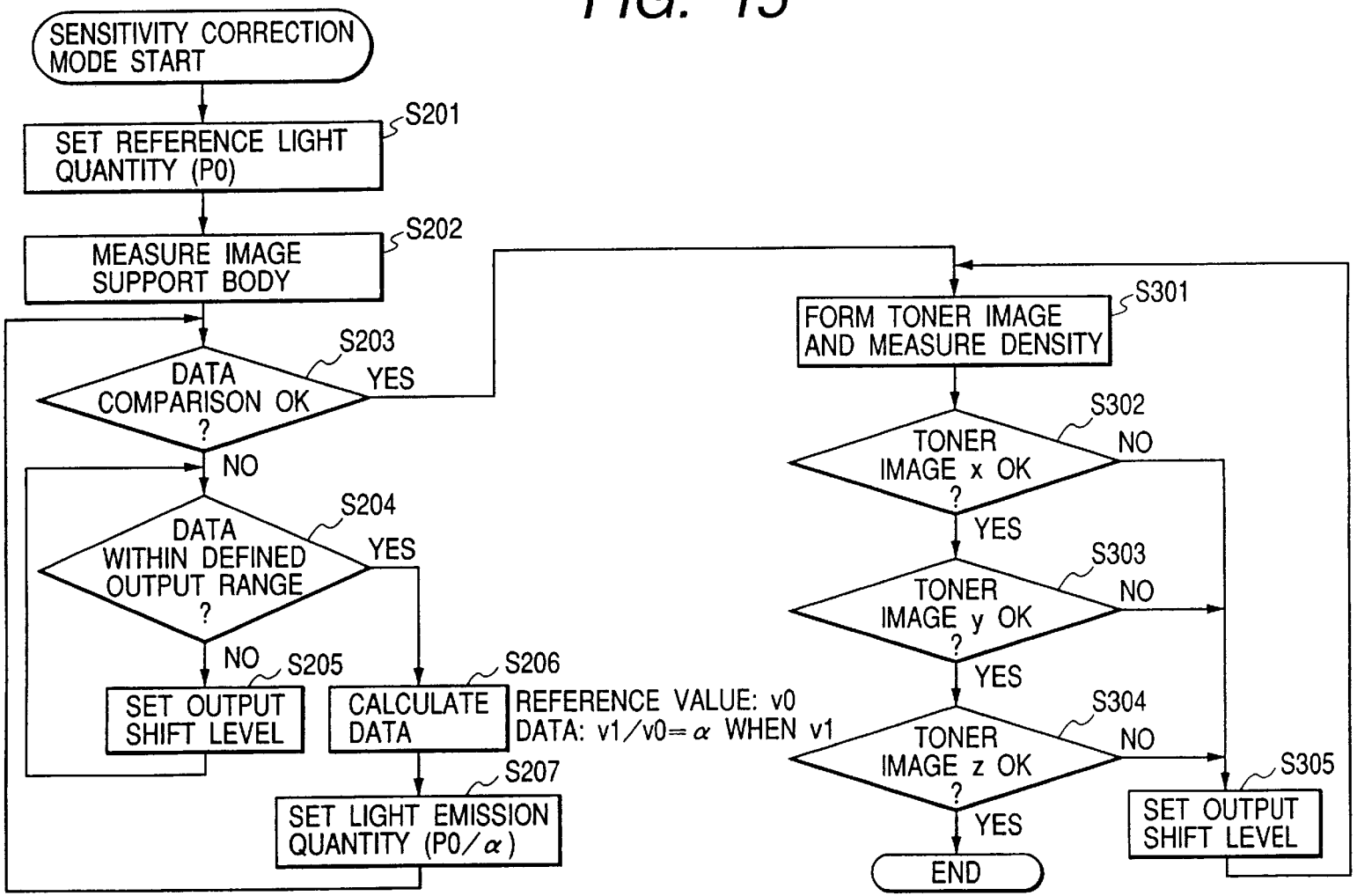
FIG. 15 is a flow chart showing process contents in the second embodiment of the present invention.

FIG. 15 is a flow chart for explaining an operation in the second embodiment of the present invention. The same numerals are given to the same process steps as those shown in FIG. 12 of the first embodiment and a detailed description will be omitted.

In FIG. 15, as a compared result, in a case where data of an output voltage value corresponding to surface ground density of the image support body is within an acceptable error range in a step S203, a flow advances to a step S301. In the step S301, a toner image is printed on the image support body to measure density by a density sensor 113. In the present embodiment, the number of toner images of different density to be printed on the image support body is assumed as three. However, any number of toner images may be available if the number is equal to or larger than one.

In the present embodiment, a first toner image is defined as x, a second toner image is defined as y and a third toner image is defined as z. The flow advances to a step S302. If an obtained result of measuring density of the toner image a is within an output voltage range, the flow advances to a step S303. In a case where the obtained result of measuring the density is not within the output voltage range, the flow advances to a step S305, where an output shift level is set to shift the level. This process is repeated until the measured result is to be included within the output voltage range.

In this case, the toner image to be printed once more on the image support body may be only the toner image x. In the step S303, similar to the case in the step S302, if an obtained result of measuring density of the toner image y is within the output voltage range, the flow advances to a step S304. In a case where the obtained result of measuring the density is not within the output voltage range, the flow advances to the step S305, where the output shift level is set to shift the level. This process is repeated until the measured result is to be included within the output voltage range.

In this case, the toner image to be printed once more on the image support body may be only the toner image y. In the step S304, similar to the case in the step S302, if an obtained result of measuring density of the toner image z is within the output voltage range, a measuring error should not be occurred when the density of the toner image is controlled, thereby outputting data. In a case where the obtained result of measuring the density is not within the output voltage range, the flow advances to the step S305, where the output shift level is set to shift the level. This process is repeated until the measured result is to be included within the output voltage range.

In this case, the toner image to be printed once more on the image support body may be only the toner image z.

Figure 16:
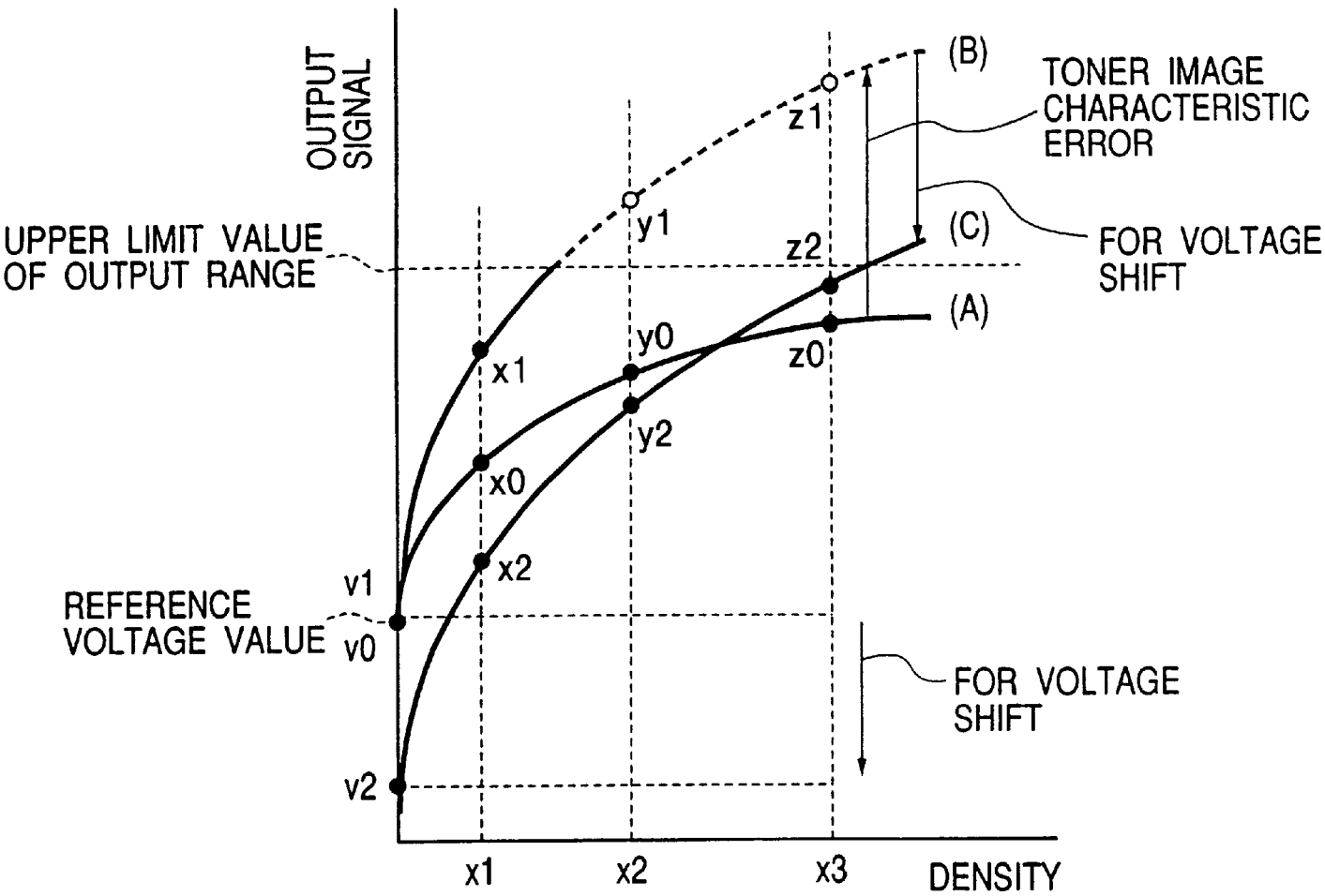
FIG. 16 is an explanation view for explaining an operation in the second embodiment of the present invention.

The above-described process will be described with reference to a graphic chart shown in FIG. 16. In FIG. 16, as a result of measuring the density, obtained output voltage values of the three toner images of different density are assumed as x0, y0 and z0 respectively. These output voltage values are to be existed on a reference ideal curve (A) after terminating a sensitivity correction by measuring the surface density of the image support body 100 by the density sensor. Output voltage values of the density sensor when the toner images are actually printed on the image support body are assumed as x1, y1 and z1 respectively and a curve obtained by connecting each of the three points is assumed as (B). In a case where an output of actually measured toner image density exceeds an upper limit value of output range, the output shift level is set to shift the level such that a density output value is to be included within the output range. At this time, output voltage values are assumed as x2, y2 and z2 respectively and a sensitivity characteristic curve of the density sensor is assumed as (C). At this time, if the output voltage value y2 or z2 is not within the output range, the output shift level has to be further decreased.

In a case where a characteristic of the density sensor is deteriorated because of dirt of the density sensor due to dust such as toners, the output shift level has to be increased.

For the toner images to be printed on the image support body in the above-described description, any toner of yellow, magenta, cyan or black may be used.

A calculating formula indicating sensitivity characteristic curves of the density sensor shown in FIG. 13 can be obtained by a statistical method (e.g., least square method) on the basis of the output values of density of the three toner images. Upon obtaining this calculating formula by a calculating function of a CPU, since density other than the above-described density of the three images, for example, an output value of the density sensor for a maximum density (called as expectation value or prediction value) can be obtained, it is judged whether or not the output value for the maximum density is included within a tolerance. When a denied judgment is obtained, the above-described light quantity and the output shift level may be variably set. As to a minimum density, of course, the same process may be executed. Therefore, the sensitivity characteristic curves of the density sensor can be included within the tolerance.

It is preferable that the sensitivity correction of the density sensor described in the above-described first and second embodiments may be performed just before setting of an image formation condition such as a toner density control or the like described in the conventional example.

Third Embodiment

A circuit structure in the third embodiment is identical with that in the first embodiment shown in FIG. 11.

Figure 17:
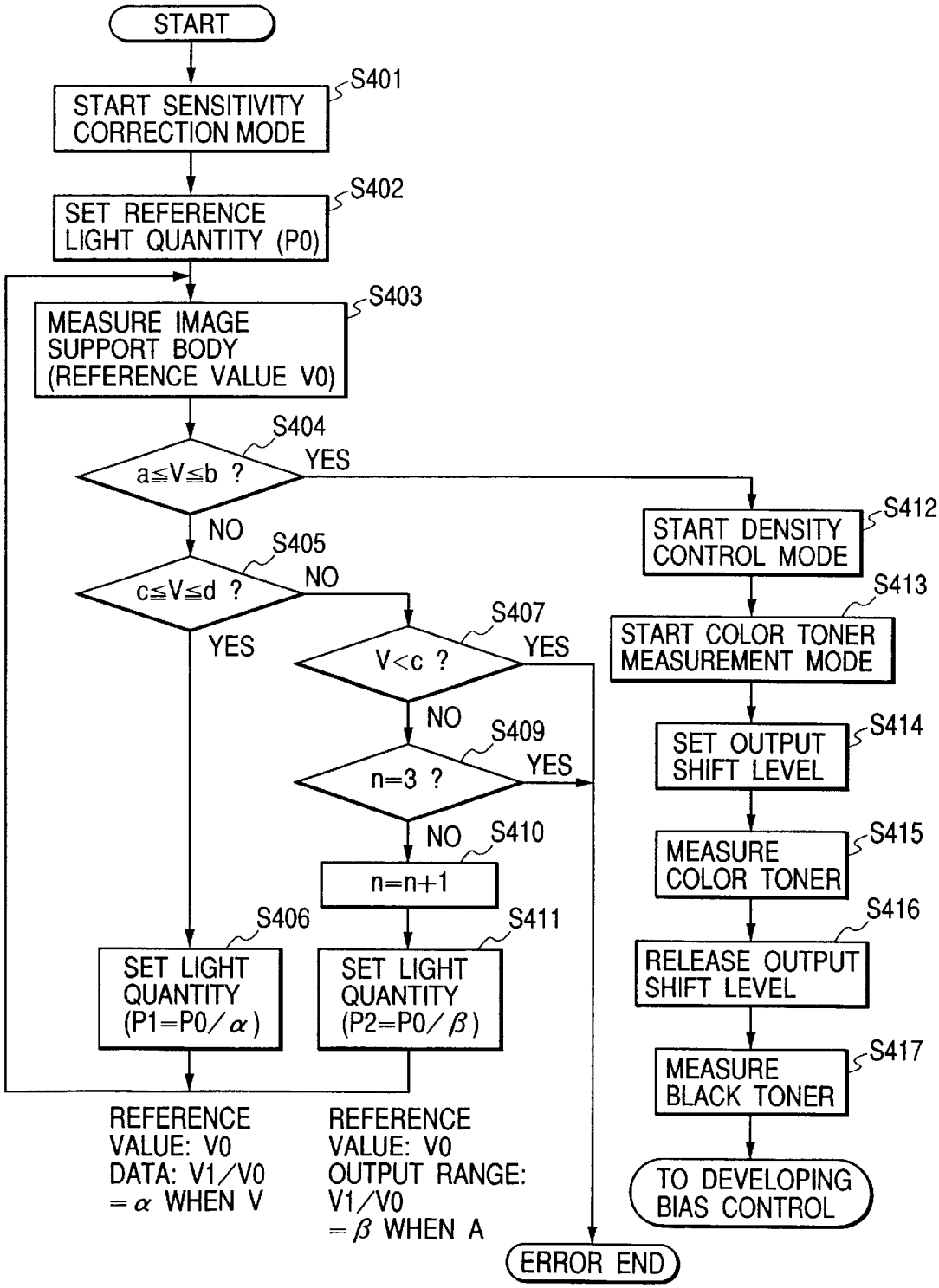
FIG. 17 is a flow chart showing process contents in a third embodiment of the present invention.

FIG. 17 is a flow chart for explaining an operation in the third embodiment of the present invention. In FIG. 17, when a sensitivity correction mode is started in a step S401, at first, a reference light quantity (P0) used in measuring surface ground density of an image support body 100 is set by an LED light quantity setting unit 5 according to a command from an initial setting means 11 in a step S402. In a step S403, the image support body 100 is radiated with the reference light quantity P0 to measure the density using a reflected light. At this time, a reference voltage value of the surface ground density of the image support body 100 is assumed as V0 and a measured value is assumed as V. A flow advances to a step S404. An output voltage obtained by measuring the surface ground density of the image support body 100 is transmitted to a CPU 50 in the step S403 and is converted into digital data by an A/D converter 3, thereafter, the data is compared if it is within an acceptable error range for the reference voltage value by a data comparison means 4. Reference symbols a and b shown in the step S404 respectively denote a lower limit value and an upper limit value of an error tolerance so as to shift to a density control mode.

If the compared result is in NO state, the flow advances to a step S405, where it is judged whether or not the data transmitted to the data comparison means 4 is within a defined output voltage range. Herein, the defined output voltage range means such a range as enabling to correct sensitivity within an output voltage range of a density sensor 113. Reference symbols c and d respectively denote a lower limit value and an upper limit value of this range. In a case where the data is within the defined output voltage range, the flow advances to a step S406 to set a light emission quantity P1 used in correcting the sensitivity of the image support body. For example, when the measured value is V for the reference voltage value V0, a correction light quantity $P1=P0/\alpha$ ($\alpha=V/V0$) is to be set. Thereafter, the flow returns to the step S403 to repeat the consecutive process until the transmitted data is included with the defined output voltage range.

In the step S405, in a case where the data is not within the defined output voltage range, the flow advances to a step S407 to judge whether or not the measured value V is lower than a lower limit value of a sensitivity correctable range ($V<c$). In a case where the measured value is lower than the lower limit value, the process is terminated as an error. If the measured value V is not lower than the lower limit value c, since the measured value is to be upper than the upper limit value d, subsequently, in a step S409, light quantity of an LED is corrected to judge whether or not the number of measuring times of measuring the density reaches three. If the number of measuring times reaches three, the process is terminated as an error. If the number of measuring times does not reach three, reference symbol n, which represents the measuring times, is counted up by one in a step S410 and the flow advances to a step S411. It should be noted that a value of n is initialized when the sensitivity correction mode is to be started. In case of advancing to the step s411, it is expected that the measured value V exceeds the output range of the density sensor. In this case a correction light quantity P2 is set. For example, when an upper limit value of the output range of the density sensor is assumed as A, the correction light quantity $P2=P0/\beta$ ($\beta=A/V0$) is to be set. After setting the correction light quantity P2, the flow returns to the step S403, where the density is measured to perform a comparison.

Figure 18:
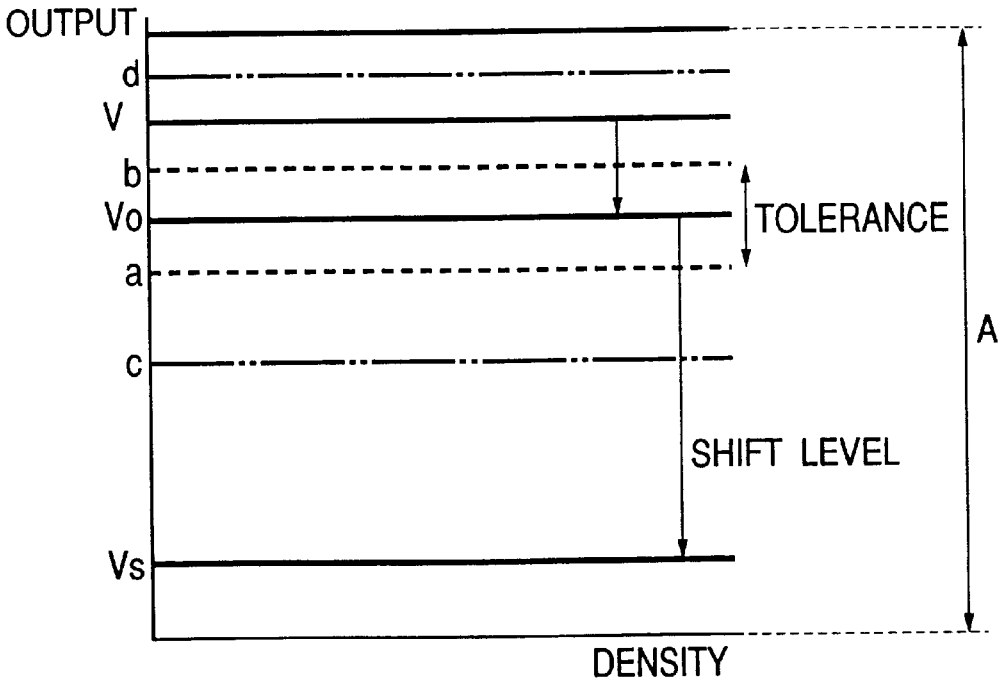
FIG. 18 is an explanation view for explaining an operation in the third embodiment of the present invention.
Figure 19:
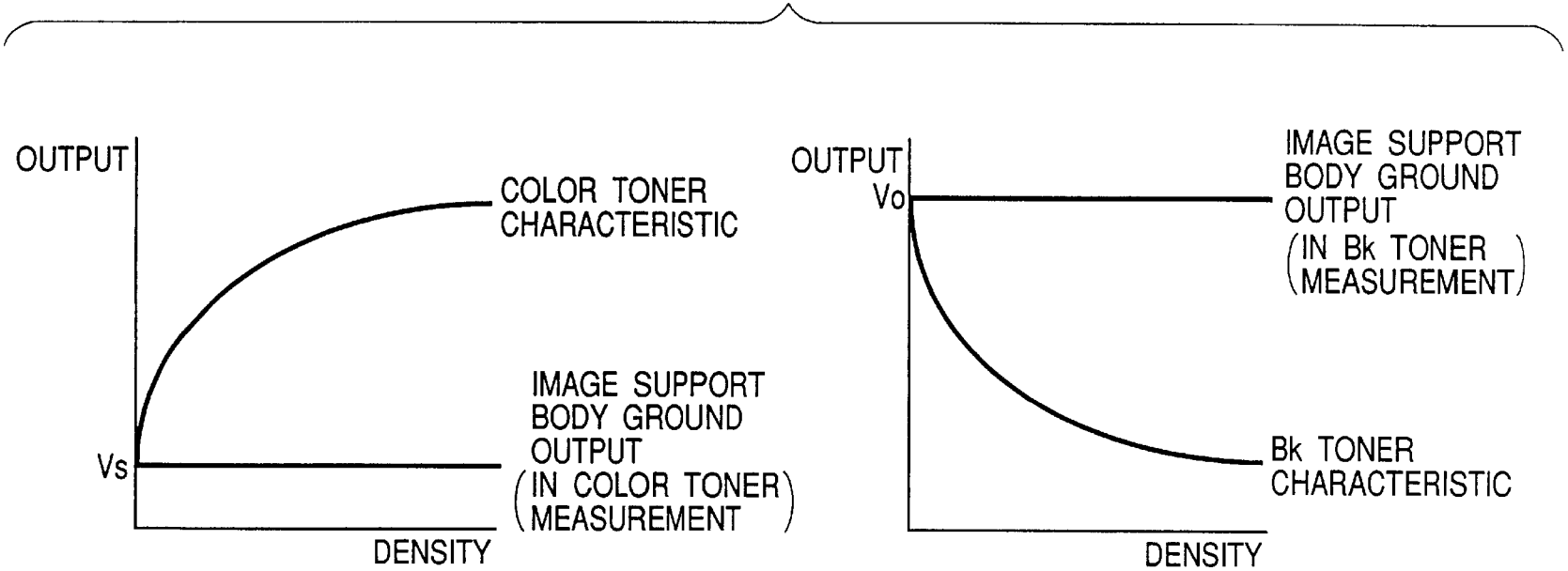
FIG. 19 is an explanation view for explaining the operation in the third embodiment of the present invention.

In the step S404, if the measured value V is included within the error tolerance, the flow advances to a step S412. From this step S412, the density control mode is started. At first, in a step S413, it is shifted to a color toner image measuring mode. The flow advances to a step S414, where a shift level ($|V0-Vs|$) equivalent to the quantity shown in FIG. 18 is set for the output voltage of the density sensor. The shift level, which is a fixed value previously determined according to individual dispersion of the image support body, can be optionally varied. Therefore, since an output signal from the sensor becomes to be indicated by such a form as shown in FIG. 19, a dynamic range of the A/D converter 3 can be effectively used. Reference symbol Vs denotes a ground output value of the image support body defined by setting the shift level of the density sensor. After setting the shift level, a plurality of color toner images of different density are formed and the density thereof is measured in a step S415. When it is terminated to measure the density of the color toner images, the flow advances to a step S416 to release the previously set shift level. The flow advances to a step S417, where a plurality of black toner images of different density are formed and the density thereof is measured.

According to the above order, when the sensitivity of the density sensor is corrected and the density of the toner image is measured, the process is shifted to a developing bias control.

In the above-described embodiments, a case of changing the sensitivity of the image support body is described.

However, also in case of decreasing the light emission quantity because of dirt of the density sensor due to dust such as toners, a correction can be similarly performed by varying the light emission quantity and the output voltage shift quantity.

It is preferable to perform the sensitivity correction of the density sensor in the above-described embodiment just before setting an image formation condition such as a toner density control or the like described in the conventional example.

The present invention is not limited to the above-described embodiments, but, various modifications can be effected within the scope of the appended claims.

What is claimed is:

1. A density control apparatus comprising:

image formation means for forming an image signal;

a sensor for measuring density of the toner image formed on the photosensitive body;

correction means for causing said sensor to measure density of a portion where the toner image is not performed on the photosensitive body and correcting sensitivity of said sensor on the basis of the measured result;

setting means for setting a level shifting quantity of an output signal from said sensor after the sensitivity of said sensor is corrected by said correction means; and determination means for causing said image formation means to form plural images for density measurement, the plural images having different densities respectively, and for determining an image formation condition on the basis of the result of measuring the densities of the plural images for density measurement and the shifting quantity set by said setting means.

2. An apparatus according to claim 1, wherein said sensor has a light emitting element and a light reception element and said correction means corrects a light quantity of the light emitting element such that an output from the light reception element is to be included within a predetermined range.

3. An apparatus according to claim 1, wherein said image formation means forms the toner image in each of every plural color components and said setting means sets the shifting quantity when density of an image, of which color component is other than black, is measured.

4. A density control apparatus which controls an image formation condition on the basis of a result of measuring density of an image used in measuring the density formed on an image support body, said apparatus comprising:

image formation means for forming an image on the image support body;

a sensor for radiating a beam on the image used in measuring the density and measuring the density upon receiving a reflected light;

judgment means for judging whether or not sensitivity of the density sensor is within a tolerance; and correction means for correcting the sensitivity of said sensor by setting a light emission quantity of said sensor and a level shifting quantity of an output signal from said sensor such that the sensitivity is to be included within the tolerance in a case where the sensitivity is not within the tolerance.

5. An apparatus according to claim 4, wherein an operation of said correction means is performed before measuring the density of the image used in measuring the density intended to control the image formation condition.

6. An apparatus according to claim 4, wherein said judgment means obtains a sensitivity characteristic curve of said sensor on the basis of the result of measuring density of plural test images of different density to be formed on the image support body and said correction means sets the light emission quantity and the level shifting quantity such that the sensitivity characteristic curve is to be included within the tolerance.

7. A density control apparatus comprising:

image formation means for forming an image on an image support body;

a density sensor for measuring density of the image formed on the image support body;

correction means for correcting sensitivity of the density sensor;

shift means for shifting level of an output signal from the density sensor; and control means for causing said shift means to shift the level of the output signal after the sensitivity is corrected by said correction means, wherein said control means determines an image formation condition on the basis of a density output signal of an image newly formed after shifting the level.

8. An apparatus according to claim 7, wherein said image formation means forms the image in each of every plural color components on the image support body and said control means operates said shift means when density of an image, of which color component is other than black, is measured.

9. An apparatus according to claim 7, wherein the density sensor has a light emitting element and a light reception element and said correction means corrects a light quantity of the light emitting element such that an output from the light reception element is to be included within a predetermined range when ground density of the image support body is measured.

10. An apparatus according to claim 7, wherein said shift means shifts the level of the output signal such that the output signal from the density sensor is to be included within a predetermined range.

11. An apparatus according to claim 9, wherein said controls means performs an error process when the output from the light reception element is not included within the predetermined range even if predetermined times of corrections are repeated by said correction means.

12. An apparatus according to claim 7, wherein said control means causes to form plural images of different densities on the image support body after shifting the level and determines the image formation condition on the basis of the result of measuring the densities of the plural images.

13. A density control method which measures density of a toner image formed on a photosensitive body using a sensor and controls an image formation condition on the basis of the measured result, used for an image formation apparatus, said method comprising the steps of:

measuring density of a portion where a toner image is not formed on the photosensitive body;

correcting sensitivity of the sensor on the basis of the measured result;

setting a level shifting quantity of an output signal from the sensor after correcting the sensitivity of the sensor;

forming plural images having different densities used in density measurement; and determining an image formation condition on the basis of density measurement, the plural images having different densities respectively and for density measurement and the shifting quantity set in said setting step.

14. A method according to claim 13, wherein the sensor has a light emitting element and a light reception element and a light quantity of the light emitting element is corrected such that an output from the light reception element is to be included within a predetermined range in said correction step.

15. A method according to claim 13, wherein the image formation apparatus forms the toner image in each of every plural color components and the shifting quantity is set when density of an image, of which color component is other than black, is measured in said setting step.

16. A density control method which measures density of an image used in measuring the density formed on an image support body using a density sensor and controls an image formation condition on the basis of the measured result, used for an image formation apparatus, said method comprising the steps of:

radiating a beam on the image support body to receive a reflected light;

judging whether or not sensitivity of the density sensor is within a tolerance on the basis of a light reception quantity; and correcting the sensitivity of the sensor by setting a light emission quantity of the sensor and a level shifting quantity of an output signal from the sensor such that the sensitivity is to be included within the tolerance in a case where the sensitivity is not within the tolerance.

17. A method according to claim 16, wherein a process in said correcting step is to be executed before measuring the density of the image used in measuring the density intended to control the image formation condition.

18. A method according to claim 16, wherein a sensitivity characteristic curve of the sensor is obtained on the basis of the result of measuring density of plural test images of different densities to be formed on the image support body in said judging step and the light emission quantity and the level shifting quantity are set in said correcting step such that the sensitivity characteristic curve is to be included within the tolerance.

19. A density control method which measures density of an image formed on an image support body using a density sensor and controls an image formation condition on the basis of the measured result, used for an image formation apparatus, said method comprising the steps of:

correcting a sensitivity of the density sensor;

causing to shift a level of an output signal from the density sensor after the sensitivity is corrected; and determining an image formation condition on the basis of a density output signal of an image newly formed after shifting the level.

* * * * *

UNITED STATES PATENT AND TRADEMARK OFFICE

CERTIFICATE OF CORRECTION

PATENT NO. : 6,246,844 B1
DATED : June 12, 2001
INVENTOR(S) : Hiroshi Shiba

It is certified that error appears in the above-identified patent and that said Letters Patent is hereby corrected as shown below:

Column 1,
Line 30, "The each of" should read -- Each of the --.

Column 2,
Line 55, "want" should read -- wants --.;

Column 4,
Line 44, "a" should read -- an --.

Column 5,
Line 34, "an" should read -- a --; and
Line 56, "compared" should read -- compared to --.

Column 6,
Line 63, "are to be existed" should read -- are to exist --.

Column 10,
Line 41, "controls" should read -- control --; and
Line 46, "causes to form" should read -- forms --.

Signed and Sealed this

Twenty-sixth Day of February, 2002

*Attest:*

*Attesting Officer*

JAMES E. ROGAN
*Director of the United States Patent and Trademark Office*